United States Patent [19]

Faulring et al.

[11] 4,361,442

[45] Nov. 30, 1982

[54] VANADIUM ADDITION AGENT FOR IRON-BASE ALLOYS

[75] Inventors: Gloria M. Faulring, Niagara Falls; Alan Fitzgibbon, Lewiston; Frank Slish, Grand Island, all of N.Y.

[73] Assignee: Union Carbide Corporation, Danbury, Conn.

[21] Appl. No.: 249,444

[22] Filed: Mar. 31, 1981

[51] Int. Cl.[3] ..... C21C 7/00

[52] U.S. Cl. ..... 75/57; 75/3; 75/53; 75/129

[58] Field of Search ..... 75/53, 57, 129, 3

[56] References Cited

U.S. PATENT DOCUMENTS

| | | | |
|---|---|---|---|
| 2,888,342 | 5/1959 | Fraser | 75/3 |
| 3,239,330 | 3/1966 | Carpenter | 75/3 |
| 3,565,610 | 2/1971 | Retelsdorf | 75/129 |
| 3,579,328 | 5/1971 | Svelgen | 75/129 |
| 3,591,367 | 7/1971 | Perfect | 75/129 |

*Primary Examiner*—P. D. Rosenberg

*Attorney, Agent, or Firm*—John R. Doherty

[57] ABSTRACT

Addition of vanadium to molten iron-base alloys using an agglomerated mixture of $V_2O_5$ and calcium-bearing reducing agent.

7 Claims, No Drawings

VANADIUM ADDITION AGENT FOR IRON-BASE ALLOYS

The present invention is related to the addition of vanadium to molten iron-base alloys, e.g., steel. More particularly, the present invention is directed to the use of an addition agent comprising $V_2O_5$ and a calcium-bearing reducing agent.

It is a common requirement in the manufacture of iron-base alloys, e.g., steel, to make additions of vanadium to the molten alloy.

Previous commercial techniques have involved the use of vanadium and carbon, and vanadium, carbon and nitrogen containing materials as disclosed in U.S. Pat. No. 3,040,814.

Said materials, while highly effective in many respects, require processing techniques that result in carbon and nitrogen containing additions. These products cannot be satisfactorily employed in all applications, e.g., the manufacture of pipe steels where low carbon content is critical.

Pelletized mixtures of $V_2O_5$ plus aluminum; $V_2O_5$ plus silicon plus calcium-silicon alloy; $V_2O_5$ plus aluminum plus calcium-silicon, and "red-cake" plus 21%, 34% or 50% calcium-silicon alloy have been previously examined as a source of vanadium in steel by placing such materials on the surface of molten steel. The "red cake" used was a hydrated sodium vanadate containing 85% $V_2O_5$, 9% $Na_2O$ and 2.5% $H_2O$.

The results were inconclusive probably due to oxidation and surface slag interference.

It is therefore an object of the present invention to provide a vanadium addition for iron-base alloys, especially steel, which does not require energy in preparation and which enables, if desired, the efficient addition of the vanadium metal constituent without adding carbon or nitrogen.

Other objects will be apparent from the following descriptions and claims.

The vanadium-addition agent of the present invention is a blended, agglomerated mixture consisting essentially of $V_2O_5$ (at least 95% by weight $V_2O_5$) and a calcium-bearing reducing agent. The mixture contains about 40–50% by weight of $V_2O_5$ and 50 to 60% by weight of calcium-bearing reducing agent. In a preferred embodiment of the present invention, the calcium-silicon alloy used as a reducing agent contains about 28–32% by weight Ca and 60–65% by weight Si, primarily as the phases $CaSi_2$ and Si; the alloy may advantageously contain up to about 8% by weight of iron, aluminum, barium, and other impurities incidental to the manufacturing process, i.e., the manufacture of calcium-silicon alloy by the electric furnace reduction of CaO and $SiO_2$ with carbon. (Typical analyses: Ca 28–32%, Si 60–65%, Fe 5.0%, Al 1.25%, Ba 1.0%, and small amounts of impurity elements.)

In the practice of the present invention a blended, agglomerated mixture of $V_2O_5$ and calcium-silicon alloy may be used in substantially the following proportions: 40% to 50% by weight $V_2O_5$ and 50% to 60% by weight calcium-silicon alloy.

The particle size of the calcium-silicon alloy is predominantly (more than 90%) 8 mesh and finer (8 M×D) and the $V_2O_5$ is sized predominantly (more than 90%) $\frac{1}{8}$" and finer.

The mixture is thoroughly blended and thereafter agglomerated, e.g., by conventional compacting or briquetting techniques so that the particles of the $V_2O_5$ and reducing agent such as calcium-silicon alloy particles are closely associated in intimate contact.

The closely associated agglomerated mixture is added to molten steel where the heat of the metal bath and the reducing power of the reducing agent are sufficient to activate the reduction of the $V_2O_5$. The metallic vanadium generated is immediately integrated into the molten metal.

To achieve satisfactory vanadium recovery, any significant exposure of the addition to oxidizing conditions, such as the high temperature atmosphere above the molten metal and/or slag on the melt surface, is to be avoided when the agglomerated $V_2O_5$ plus reducing agent mixture is added to the molten metal in view of the tendency of calcium-silicon to oxidize and the relatively low melting point (690° C.) of $V_2O_5$. The CaO and $SiO_2$ formed when the vanadium oxide is reduced enters the slag except when the steel is aluminum deoxidized. In that case, the $SiO_2$ enters the slag but the CaO generated reacts with the $Al_2O_3$ inclusions resulting from the deoxidation practice.

It is important that the addition agent of the present invention be rapidly immersed in the molten metal to minimize any reaction with oxygen in the high temperature atmosphere above the molten metal which would oxidize the calcium bearing reducing agent. Also, contact of the addition agent with any slag or slag-like materials on the surface of the molten metal should be avoided so that the reactivity of the addition is not diminished by a coating of the slag or a reaction with the slag. This may be accomplished by several methods. For example, by plunging the addition agent, encapsulated in a container, into the molten metal or by adding compacted mixture to the pouring stream during the transfer of the molten metal from the furnace to the ladle. In order to ensure rapid immersion of the addition agent into the molten metal, the ladle should be partially filled to a level of about one-quarter to one-third full before starting the addition and the addition should be completed before the ladle is filled.

The following example will further illustrate the present invention.

EXAMPLE

Procedure

Armco iron was melted in a magnesia-lined induction furnace with argon flowing through a graphite cover. After the temperature was stabilized at 1600° C.±10° C., the heat was blocked with silicon. Next, except for the vanadium addition, the compositions of the heats were adjusted to the required grade. After stabilizing the temperature at 1600° C.±5° C. for one minute, a pintube sample was taken for analyses and then a vanadium addition was made by plunging a steel foil envelope containing the briquetted or agglomerated vanadium addition plus reducing agent mixture into the molten steel. The steel temperature was maintained at 1600° C.±5° C., with the power on the furnace for three minutes after addition of the $V_2O_5$ plus reducing agent mixture. Next, the power was shut off and after one minute, pintube samples were taken and the steel cast into a 100-pound, 10.2 cm (4") ingot. Subsequently, specimens removed from mid-radius the ingot, one-third up from the bottom, were examined microscopically and analyzed chemically. Some were analyzed on the electron microprobe.

Various mixtures of $V_2O_5$ and reducing agents such as ferrosilicon (75% Si), silicon, aluminum, and calcium-silicon alloy were added as a source of vanadium in molten steels. In addition, a series of steels was made with the particle size of the reducing agent, calcium-silicon alloy, as the only variable. The vanadium recoveries from these experimental heats are shown in Table I. The preferred particle-size range of the calcium-silicon alloy is 8 mesh and finer (8M×D) for the following reasons:

(i) commercially available;

(ii) more economical and less hazardous to produce than a finer particle size, and (iii) can be briquetted or pelletized commercially.

The particle-size distribution of this material is presented in Table III.

When small increases in the carbon or carbon-plus-nitrogen content of the steel are either acceptable or advantageous for the steel-maker, $CaC_2$ and/or $CaCN_2$ can be employed as the reducing agent instead of the calcium-silicon alloy. As shown in Table IV, vanadium can be added to these steels by reducing $V_2O_5$ with calcium carbide or calcium cyanamide in the molten steel.

Various $V_2O_5$ plus reducing agent mixtures were added to molten steel as sources of vanadium. The results, summarized in Tables I, II and IV, are discussed below.

In the experimental heats listed in Table I, it may be noted that several reducing agents such as ferrosilicon (75% Si), silicon, commercial-grade magnesium-ferrosilicon, aluminum, and aluminum with ferrosilicon (75% Si) plus calcium oxide (flux), will reduce $V_2O_5$ in molten steel. However, for all these mixtures, the vanadium recoveries in the steel were less than 80%. However, when the vanadium source was a closely associated mixture of $V_2O_5$ plus calcium-silicon alloy, the vanadium recoveries were a maximum, increasing from 70 to 95%. as the percentage of calcium-silicon alloy in the compact increased from 40 to 60%. Whether the $V_2O_5$ source was high-purity granular (10M×D), technical flake ($\frac{1}{8}$"×D), or technical granular (10M×D), did not measurably influence the vanadium recovery as can be seen from Table II.

In addition, the particle-size distribution of the calcium-silicon alloy did not effect the vanadium recoveries.

It has also been determined that commercial-grade calcium carbide and the chemical compound, calcium cyanamide, are also effective in reducing $V_2O_5$ and adding vanadium to steel as shown in Table IV. The carbon and nitrogen contents of the molten steel, before and after the calcium carbide plus $V_2O_5$ and calcium cyanamide plus $V_2O_5$ additions, are included.

Specimens removed from the ingots were analyzed chemically and also examined optically. Frequently, the inclusions in the polished sections were analyzed on the electron microprobe. During this examination, it was determined that the CaO generated by the reduction reaction reacts with the alumina inclusions characteristic of aluminum-deoxidized steels. Thus, the addition of the $V_2O_5$ plus calcium-silicon alloy mixture to molten steel not only supplies vanadium, but also the CaO generated modifies the alumina inclusions in aluminum-deoxidized steels. The degree of modification depends on the relative amounts of calcium and aluminum in the molten steel.

The mesh sizes referred to herein are United States Screen Series.

TABLE I

Vanadium Additives for Steel

| Steel Type | Heat No. | % $V_2O_5$* | Reducing Agent Identity | Reducing Agent % Wt. | Reducing Agent Particle Size | Addition Method** | % V Added | % V Recov'd Furnace-"3-Min." |
|---|---|---|---|---|---|---|---|---|
| Low C Steel | | | | | | | | |
| 0.08% C | J476 | 66 | FeSi(75%) | 34 | | B | 0.07 | 39 |
| 0.30% Si | | | | | | | | |
| 1.60% Mn | J477 | 47 | CaSi | 53 | 150M × D | B | 0.07 | 80 |
| 6118 Grade: | | | | | | | | |
| 0.16–0.23% C | J524 | 60 | Si | 40 | | B | 0.19 | 32 |
| 0.1–0.3% Si | | | | | | | | |
| 0.5–0.65% Mn | J525 | 55 | Si | 35 | 150M × D | B | 0.19 | 37 |
| | | | CaSi | 10 | | | | |
| | J523 | 66 | FeSi(75%) | 34 | | B | 0.35 | 37 |
| | J866 | 40 | CaSi | 60 | 8M × D | B | 0.20 | 90 |
| | | | FeSi(75%) | 15 | | | | |
| | J551 | 32 | Al | 3 | | P | 0.19 | 49 |
| | | | CaO(flux) | 50 | | | | |
| | J598 | 70 | Al | 30 | Powder | P | 0.19 | 58 |
| | J549 | 72 | CaSi | 28 | 150M × D | P | 0.19 | 74 |
| | J550 | 65 | CaSi | 35 | 150M × D | P | 0.19 | 74 |
| | J584 | 50 | MgFeSi | 50 | 8M × D | P | 0.19 | 74 |
| | J585 | 65 | CaSi | 35 | 8M × D | P | 0.19 | 84 |
| | J486 | 47 | CaSi | 53 | 150M × D | B | 0.16 | 88 |
| Low C Steel | | | | | | | | |
| 0.08–0.10% C | J849 | 40 | CaSi | 60 | 8M × D | B | 0.20 | 95 |
| 0.25–0.38% Si | J850 | 52 | CaSi | 48 | 8M × D | B | 0.20 | 80 |
| 1.44–1.52% Mn | J851 | 60 | CaSi | 40 | 8M × D | B | 0.20 | 70 |
| 0.05–0.07% Al | J859 | 52 | CaSi | 48 | 150M × D | B | 0.20 | 80 |
| | J860 | 52 | CaSi | 48 | 100M × D | B | 0.20 | 80 |
| | J850 | 52 | CaSi | 48 | 8M × D | B | 0.20 | 80 |
| | J861 | 52 | CaSi | 48 | 6M × 8M | B | 0.20 | 85 |

TABLE I-continued

Vanadium Additives for Steel

| Steel Type | Heat No. | % $V_2O_5$* | Reducing Agent Identity | % Wt. | Particle Size | Addition Method** | % V Added | % V Recov'd Furnace-"3-Min." |
|---|---|---|---|---|---|---|---|---|
| | J862 | 52 | CaSi | 48 | 3M × 4M | B | 0.20 | 80 |

*High purity granular $V_2O_5$, 99% $V_2O_5$, 10M × D - commercial product, UCC.
**P: Tightly packed in steel foil envelope. B: Briquetted in hand press with a binder and packed in steel foil envelope. All additions made by plunging the addition mixtures into the molten steel in steel envelopes.

TABLE II

Effect of $V_2O_5$ Source on Vanadium Recovery in Low Carbon Steel*

| Heat No. | % $V_2O_5$ | % CaSi (8M × D) | % V Added | % V Recov'd. |
|---|---|---|---|---|
| J850[a] | 52 | 48 | 0.20 | 80 |
| J867[b] | 52 | 48 | 0.20 | 85 |
| J868[c] | 52 | 48 | 0.20 | 85 |

Vanadium Oxide Sources (Commercial products, UCC)
[a]J850: High purity granular $V_2O_5$ >99% $V_2O_5$ - 10M × D.
[b]J867: Technical flake $V_2O_5$ >98% $V_2O_5$ - ⅛" and down.
[c]J868: Technical granular $V_2O_5$ >99% $V_2O_5$ - 10M × D.
*0.08–0.10% C
0.25–0.38% Si
1.44–1.52% Mn
0.05–0.07% Al

TABLE III

Particle Size Distribution of Calcium-Silicon Alloy (8 Mesh × Down)

| |
|---|
| 6 Mesh - Maximum |
| 4% on 8M |
| 33% on 12M |
| 55% on 20M |
| 68% on 32M |
| 78% on 48M |
| 85% on 65M |
| 89% on 100M |
| 93% on 150M |
| 95% on 200M |

Product of Union Carbide Corporation, Metals Division

TABLE IV

Vanadium Additives for Steel Containing Carbon and Carbon Plus Nitrogen

Low-Carbon Steel Composition: 0.08–0.10% C
0.25–0.38% Si
1.44–1.52% Mn
0.05–0.07% Al

| Heat No. | % $V_2O_5$[1] | Reducing Agent Identity | % | Particle Size | % V Added | % V Recov'd Furnace-3 Min. | Increase After Addition[4] % C | % N |
|---|---|---|---|---|---|---|---|---|
| J865 | 52 | $CaC_2$[2] | 48 | 1/12" × ¼" | 0.20 | 55 | 0.026 | — |
| J869 | 52 | $CaCN_2$[3] | 48 | 200M × D | 0.10 | 80 | 0.019 | 0.0138 |

[1]$V_2O_5$ Source: High purity granular $V_2O_5$ - >99% pure, 10M × D (commercial product, Union Carbide Corporation).
[2]$CaC_2$ Source: Foundry grade, 66.5% $CaC_2$ (commercial product, Union Carbide Corporation).
[3]$CaCN_2$ Source: >99% pure, 200 M × D (chemical reagent).
[4]Difference in carbon (J865) and carbon-plus-nitrogen (J869) contents of pintube samples taken before and 3 minutes after vanadium addition.

What is claimed is:

1. A method for adding vanadium to molten iron-base alloy which comprises immersing in molten iron base alloy an addition agent consisting essentially of an agglomerated, blended mixture of about 40 to 50% by weight of finely divided $V_2O_5$ with about 50 to 60% by weight of finely divided calcium-bearing material selected from the group consisting of calcium-silicon alloy, calcium carbide and calcium cyanamide.

2. A method in accordance with claim 1 wherein said $V_2O_5$ is sized predominantly 100 mesh and finer and said calcium-bearing material is sized 8 mesh and finer.

3. A method in accordance with claim 1 wherein said calcium-bearing material is calcium-silicon alloy.

4. A method in accordance with claim 1 wherein said calcium-bearing material is calcium carbide.

5. A method in accordance with claim 1 wherein said calcium-bearing material is calcium-cyanamide.

6. A method for adding vanadium to molten iron-base alloy which comprises preparing an addition agent consisting essentially of an agglomerated, blended mixture of about 40 to 50% by weight of finely divided $V_2O_5$ with about 50 to 60% by weight of finely divided calcium-bearing material selected from the group consisting of calcium-silicon alloy, calcium carbide and calcium cyanamide, and then rapidly immersing the addition agent into the molten iron-base alloy so as to avoid any significant exposure of the addition agent to oxidizing conditions.

7. A method in accordance with claim 6 wherein the addition agent is immersed into the molten iron-base alloy in a manner such as to avoid substantial contact with any slag-like materials present on the surface of the molten metal.

* * * * *